US007972155B1

(12) United States Patent
Siebens

(10) Patent No.: US 7,972,155 B1
(45) Date of Patent: Jul. 5, 2011

(54) HOTSTICK OPERABLE ELECTRICAL CONNECTOR WITH INTEGRAL BUSHING WELL

(75) Inventor: Larry Siebens, Asbury, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 12/873,712

(22) Filed: Sep. 1, 2010

(51) Int. Cl.
*H01R 13/53* (2006.01)

(52) U.S. Cl. ..... 439/181; 439/921

(58) Field of Classification Search ..... 439/181–187, 439/921
See application file for complete search history.

(56) References Cited

U.S. PATENT DOCUMENTS

| | | | | |
|---|---|---|---|---|
| 4,202,591 | A | 5/1980 | Borgstrom | |
| 4,203,641 | A * | 5/1980 | Siebens | 439/339 |
| 4,799,895 | A | 1/1989 | Borgstrom | |
| 4,865,559 | A | 9/1989 | Clabburn | |
| 4,891,016 | A | 1/1990 | Luzzi et al. | |
| 6,796,820 | B2 * | 9/2004 | Jazowski et al. | 439/181 |
| 6,939,151 | B2 | 9/2005 | Borgstrom et al. | |
| 7,044,760 | B2 | 5/2006 | Borgstrom et al. | |
| 7,524,202 | B2 | 4/2009 | Stepniak et al. | |
| 7,556,540 | B2 | 7/2009 | Siebens et al. | |
| 2009/0017667 | A1 * | 1/2009 | Siebens et al. | 439/339 |
| 2009/0088014 | A1 | 4/2009 | Hughes et al. | |

* cited by examiner

*Primary Examiner* — James Harvey
(74) *Attorney, Agent, or Firm* — Hoffmann & Baron, LLP

(57) ABSTRACT

A hotstick operable electrical connector for use in a power distribution system that includes a housing, a well and first and second frustoconical members extending from a surface of the housing. Each frustoconical member has a distal end and an axial bore that extends from the distal end into the housing. The well includes a wall, a base with an aperture and a tapered cavity that extends into the housing from the surface opposite the frustoconical members. The well is adapted to receive a male end of an insert device, such as a feed-thru insert or bushing insert. The aperture provides communication between the cavity and the axial bore of one of the frustoconical members. An electrical contact assembly extends through the aperture between the cavity and the axial bore. The integrally formed well provides a means for direct connection with an insert device without the use of an adapter.

17 Claims, 4 Drawing Sheets

HOTSTICK OPERABLE ELECTRICAL CONNECTOR WITH INTEGRAL BUSHING WELL

FIELD OF THE INVENTION

The present invention is directed to high voltage, separable connector systems. In particular, the present invention is directed to a 200 amp, hotstick operable, separable deadbreak connector used to directly connect electrical apparatus with a bushing well male interface.

BACKGROUND OF INVENTION

The increasingly widespread use of underground power distribution systems has led to the development of larger systems utilizing components designed to handle greater amounts of power. Electrical power is typically distributed through cables that are connected to other cables and electrical equipment in the system. Separable loadbreak and deadbreak connectors and accessories provide a convenient method to connect and disconnect cables and equipment in underground power distribution systems.

A variety of different connectors and accessories are used in power distribution systems, such as separable elbow connectors, cable joints, bushings, inserts, links, cable terminations and other mating components. Electrical connectors developed for use in such systems can accommodate approximately 5 kV to 35 kV. Loadbreak elbows include provisions for energized operation using standard hotstick tools, allowing load-make and break operation and a visible disconnect. Components can be isolated with insulated caps, plugs and parking bushings. Optional accessories allow system grounding, testing, bypass, lightning surge protection and current limiting fusing. Additional connecting points and taps can be provided using junctions or feed-thrus.

The connectors for high voltage power distribution systems must be designed so that they can be manipulated by an operator at a safe distance from the connection to the high voltage electrical apparatus. To accomplish this, an insulated tool known as a "hot-stick" is used to install and service the connectors. The hot-stick allows the operator to connect, disconnect and maintain the various components in the system from a safe distance of at least 4 or 5 feet.

Proper maintenance procedures in high voltage cable systems require a circuit to be de-energized and isolated by opening switches or disconnecting the cable at both ends of the cable run. The circuit is then tested to ascertain that it is actually de-energized and each phase is grounded at both ends to prevent injury should the cable system accidentally become energized. Finally, the cables are removed from the switch or transformer bushings to achieve a visible break between the cables and their respective bushings.

In underground power distribution systems, electrical power is typically transmitted from substations through cables which interconnect other cables and electrical apparatus in a power distribution network. The cables are typically terminated on bushings that may pass through walls of metal encased equipment such as capacitors, transformers or switchgear. High voltage, separable connector systems have been developed that allow disconnection of the electrical path from a deadfront apparatus to the feeder cables connected to the apparatus bushings without moving the feeder cables and while providing visible-break isolation. The connector systems typically include a removable link or connector located between a deadfront junction mounted to the electrical apparatus and a mating connector (such as an elbow connector) joined to a cable.

The connectors (also referred to herein as "links") presently in use have bushing inserts (i.e., male connectors) that require a bushing extender and a reducing tap well in order to connect to a bushing or a feed-thru insert. One end of the reducing tap well is connected to the male interface of the bushing or feed-thru insert and the other end is connected to a bushing extender. The bushing extender is then connected to a bushing insert on a link connector.

FIGS. 1 and 2 show a prior art hotstick operable link connector 910 that has a housing 912 with two bushings 914, 916 extending from the bottom surface 918 and a third bushing 920 extending from the top surface 922. The connector 910 is attached to a feed-thru insert 924 using a bushing extender 926. After the prior art connector 910 is connected to the feed-thru insert 924, the total distance ("X") from the bottom of the connector 910 to the top of the feed-thru insert 924 is increased because the bushing extender 926 has to be used.

The multiple components in the link connectors presently being used require additional assembly time and increase the length of the connector assembly. In applications where space is limited, the increased length of the connector assembly can be a problem when installing and maintaining the connector assembly. Therefore, there is a need for a connector assembly with fewer components and a shorter overall length.

SUMMARY OF THE INVENTION

In accordance with the present invention, a hotstick operable electrical connector assembly with integral bushing well is provided. The connector for use in a power distribution system includes: a housing, first and second frustoconical members and a well. The housing has a perimetrical side wall extending between first and second surfaces. Each of the first and second frustoconical members extends from the first surface of the housing to a distal end and has an axial bore that extends from the distal end into the housing. Preferably, the axial bore in the second frustoconical member is substantially parallel to the axial bore in the first frustoconical member.

The well includes a wall, a base and a tapered cavity. The tapered cavity extends from the second surface into the housing and has a longitudinal axis that is aligned with the axial bore of the first frustoconical member. The wall extends above the second surface of the housing and surrounds the tapered cavity. The base is located in the housing and has an aperture that provides communication between the cavity and the axial bore of the first frustoconical member.

The well provides a means for directly receiving a male interface of an insert device, for example a bushing insert or a feed-thru insert, without the use of an adapter, such as a bushing extender. The integrally formed well in the connector which allows for direct connection with an insert device provides a connector assembly with a reduced overall axial height. The well further includes an electrical contact assembly that extends through the aperture in the base of the well between the cavity and the axial bore. The wall surrounding the cavity can be substantially circular and can have an exterior surface and a pair of anchors extending therefrom for engaging a hold down bail. A lever arm can be attached to the perimetrical side wall of the housing for connecting and disconnecting the connector. The lever arm has a first end attached to the housing and a second end with an aperture for operation of the lever arm with a hotstick.

BRIEF DESCRIPTION OF THE FIGURES

The preferred embodiments of the hotstick operable electrical connector assembly with integral bushing well of the present invention, as well as other objects, features and advantages of this invention, will be apparent from the accompanying drawings wherein.

DETAILED DESCRIPTION OF THE INVENTION

The present invention is a hotstick operable electrical connector assembly, which includes a connector link with an integral bushing well that provides an easier to operate and more compact connector. The design of the electrical connector eliminates the need for a bushing extender/reducing tap or other type of adapter to provide a means for receiving a male end of an insert device so that a bushing or feed-thru bushing insert can be inserted directly into the connector (also referred to as a "link"). The electrical connector with the integral bushing well conforms to ANSI/IEEE Standard 386. The bushing well in the link can have a design similar to the bushing disclosed in U.S. Pat. No. 7,556,540 to Siebens et al., which is incorporated herein in its entirety. Preferably, the connector link is constructed from a solid dielectric material, most preferably ethylene propylene diene monomer ("EPDM") rubber. High voltage electrical equipment housings constructed using high dielectric strength EPDM rubber insulation is described in U.S. Pat. Nos. 5,667,060; 5,808,258; and 5,864,942 to Luzzi, all of which are incorporated herein in their entirety. In addition to EPDM rubber, a metalized epoxy material can also be used for constructing the connector.

The electrical connector system of the present invention is a deadbreak connector. As used herein, the term "deadbreak connector" is used to refer to a connector that is designed to be separated and engaged when the equipment is de-energized. In contrast, the term "loadbreak connector" is used to refer to a connector that is designed to close or interrupt current on energized circuits.

Figure 1:
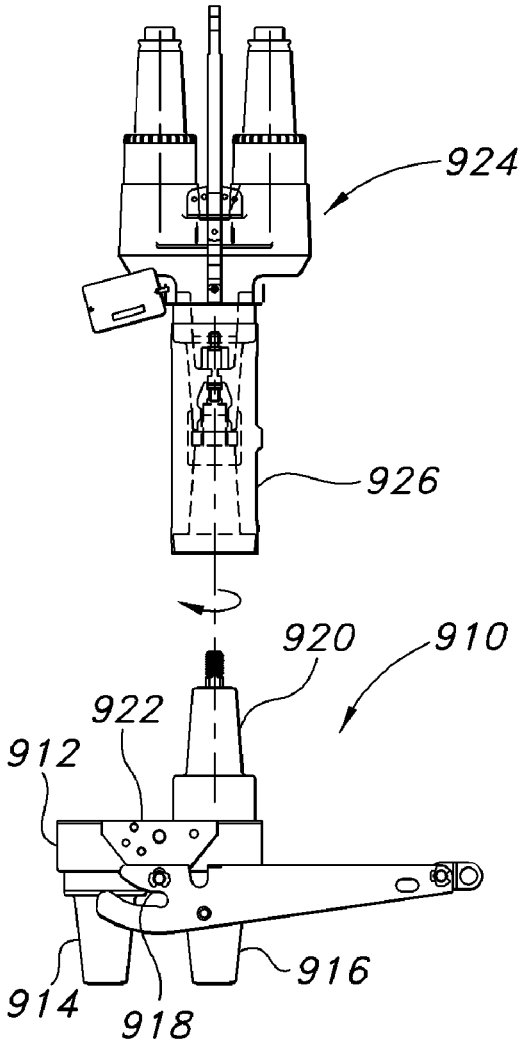
PRIOR ART FIG. 1
FIG. 1 is a side view of a prior art hotstick operable connector and a feed-thru insert attached to a bushing extender.
Figure 2:
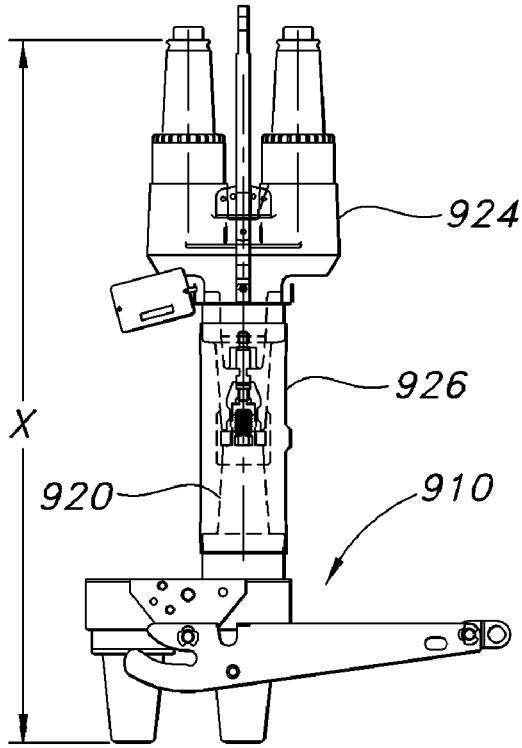
PRIOR ART FIG. 2
FIG. 2 is a side view of the prior art hotstick operable connector shown in FIG. 1 connected to the feed-thru insert using the bushing extender.

The electrical connector link with integral bushing is now described in more detailed with respect to the drawings. As discussed above, FIGS. 1 and 2 show a prior art connector 910 that uses a bushing 920 and extender 926 to connect the connector 910 to a feed-thru insert 924. FIG. 2 shows how the bushing 920 and extender 926 increases the total distance ("X") between the bottom of the connector 910 to the top of the feed-thru insert 924.

Figure 3:
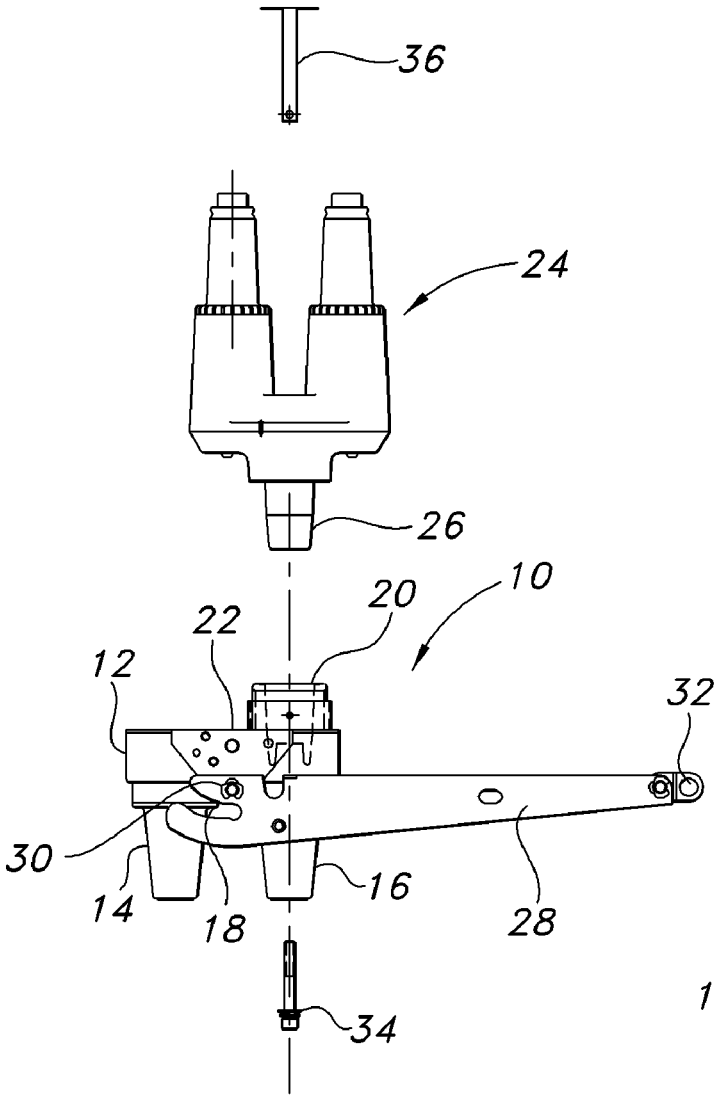
FIG. 3 is an exploded side view of the hotstick operable connector of the present invention and a feed-thru insert.
Figure 4:
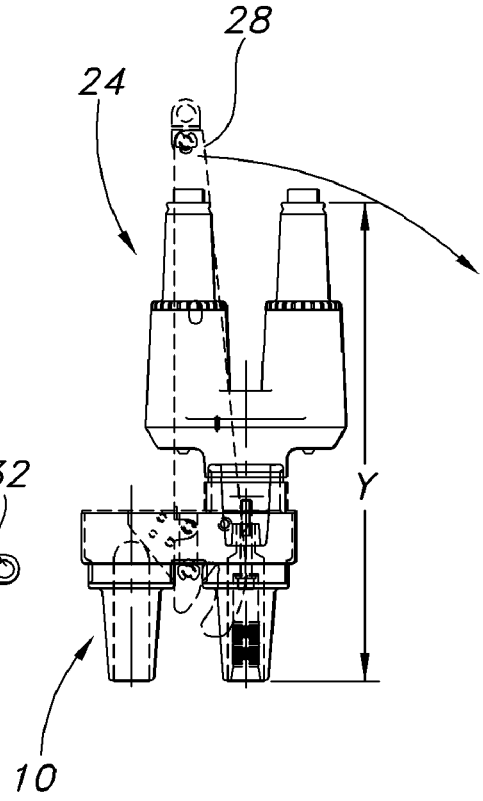
FIG. 4 is a side view of the hotstick operable connector shown in FIG. 3 connected to the feed-thru insert.

FIGS. 3 and 4 show the hotstick operable connector link 10 of the present invention, which has a total distance ("Y") between the bottom of the connector link 10 to the top of the feed-thru insert 24. The connector link 10 includes a housing 12 with two frustoconical members (i.e. bushings) 14, 16 extending from the bottom surface 18 and a bushing well 20 extending from the top surface 22. The bushings 14, 16 are connectable to be received in a bushing well (not shown), such as a female end of a bushing extender (not shown). A feed-thru insert 24 is connected directly to the connector link 10 without the use of a bushing extender. A bushing 26 on the end of the feed-thru insert 24 is inserted into the bushing well 20 so the total distance ("Y") from the bottom of the connector link 10 to the top of the feed-thru insert 24 is less than the total distance ("X") for the prior art connector 910 shown in FIG. 2, thus providing a connector assembly with a reduced height. The total distance ("Y") is also referred to herein as the "overall axial height" of the connector 10/insert 24 assembly.

FIG. 3 shows a lever arm 28 pivotably connected at one end 30 to the housing 12 and the other end of the lever arm 28 has an aperture 32 for operating the lever arm 28 using a hotstick (not shown). When the connector 10 is installed, the lever arm 28 engages a stationary bracket (not shown) and is rotated to secure the connector 10 in place. FIG. 3 also shows an assembly bolt 34 that is inserted into the bushing 26 of the feed-thru insert 24 used to complete the connection of the connector link 10 and the feed-thru insert 24. A hold-down bail 36 can also be used to secure the feed-thru insert 24 and prevent relative rotation with respect to the connector link 10.

FIG. 4 shows the connector link 10 connected to the feed-thru insert 24. The lever arm 28 is in an upright or open position. After the connector 10 is installed to a source of power, the lever arm 28 is rotated approximately 90-degrees in the clockwise direction to a closed position, which secures the connector link 10 in place. To disconnect the connector 10, the lever arm 28 is rotated in a counter clockwise direction. By eliminating the bushing extender 926 used in the prior art connector 910 (see FIGS. 1 and 2) and changing the male bushing portion 920 to a female bushing well 20, the total distance "Y" for the connector link 10 of the present invention is reduced relative to the total distance "X" for the prior art connector 910 (FIGS. 1 and 2).

Figure 5:
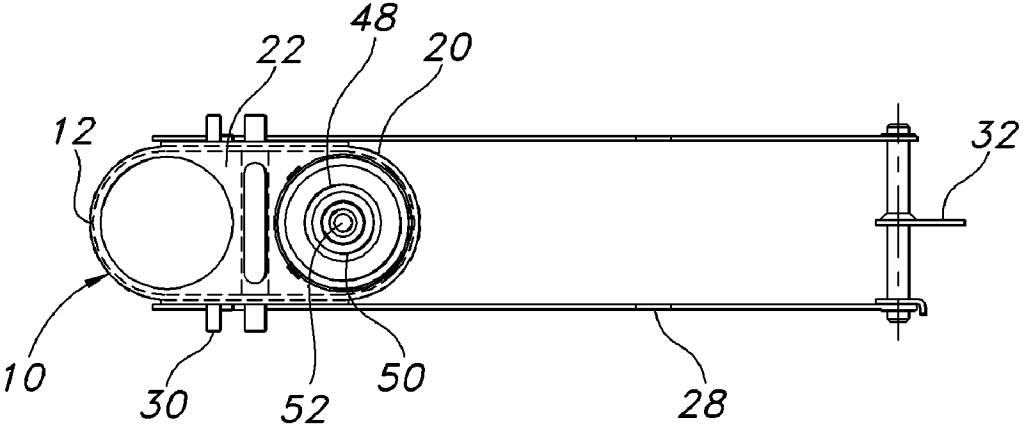
FIG. 5 is a top view of the hotstick operable connector shown in FIG. 3.
Figure 7:
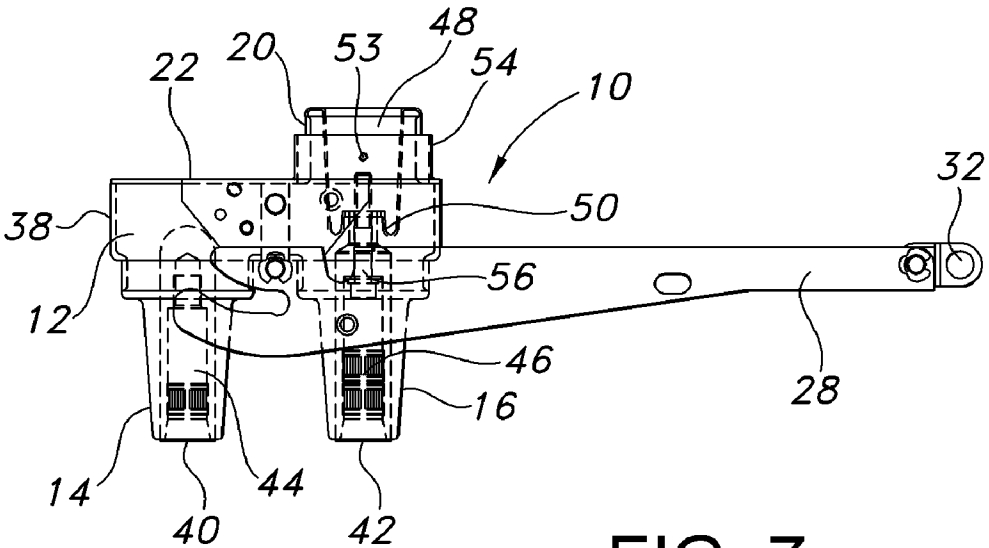
FIG. 7 is a side view of the hotstick operable connector shown in FIG. 3.
Figure 6:
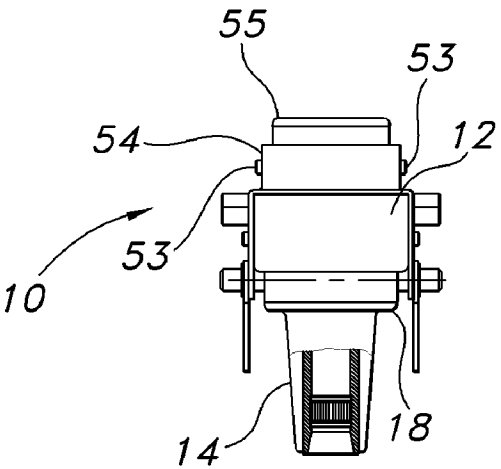
FIG. 6 is an end view of the hotstick operable connector shown in FIG. 3.
Figure 8:
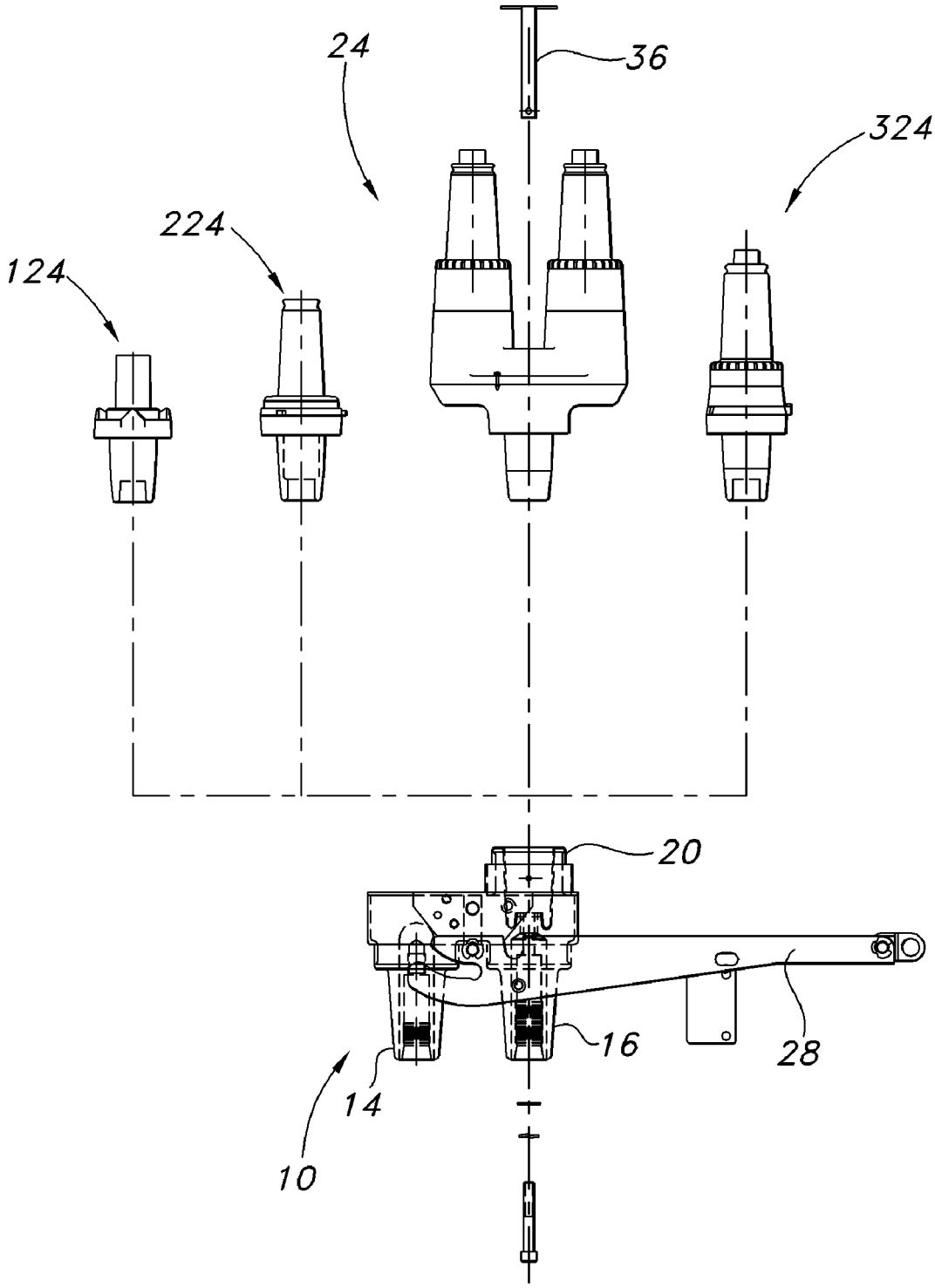
FIG. 8 is a side exploded view of the hotstick operable connector shown in FIG. 3 with four different inserts that can be connected to the connector.

FIGS. 5-7 show a top, end and side view, respectively, of the hotstick operable connector link 10. The housing 12 has a perimetrical side wall 38 extending between top surface 22 and the bottom surface 18 and two frustoconical bushing members 14, 16 that extend from the bottom surface 18 to distal ends 40, 42. Each of the frustoconical members 14, 16 has an axial bore 44, 46 that extends from the distal end 40, 42 into the housing 12. Preferably, the axial bores 44, 46 are substantially parallel. FIGS. 5 and 7 show the integrally formed bushing well 20, which has a tapered cavity 48 that extends into the housing 12 and terminates at a base 50. The tapered cavity 48 is dimensioned to receive a male bushing 26 on a feed-thru insert 24 or similar connector device such as a bushing insert 124, 224, 324 (FIG. 8). The base 50 has an aperture 52 in the center that extends between the tapered cavity 48 in the bushing well 20 and the axial bore 46 in the frustoconical member 16. The longitudinal axis of the tapered cavity 48 is aligned with the axial bore 46 of the frustoconical member 16.

FIG. 6 is an end view of the connector link 10 and it shows a pair of anchors 53 that extend from opposing sides of the bushing well wall 54. The anchors 53 are used to attach a hold down bail 36 (FIG. 6) to the connector 10. FIG. 7 shows the bushing well 20 having a wall 54, which extends from the top surface 22 of the housing 12 to a top edge 55 and surrounds the tapered cavity 48. The well 20 has an electrical contact assembly 56 that extends through the aperture 52 in the base 50 of the well 20. When the connector 10 is installed and the circuit is activated, an electrical current passes through the electrical contact assembly 56.

FIG. 8 shows the hotstick operable connector 10 and a variety of inserts that can be connected to the connector 10. The bushing well 20 of the connector 10 can receive the male interface of insert devices having different configurations as shown in FIG. 8, such as a feed-thru insert 24 or different types of bushing inserts 124, 224, 324.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

I claim:

1. An electrical connector for use in a power distribution system comprising:

a housing having a perimetrical side wall extending between first and second surfaces;

first and second frustoconical members extending from the first surface, wherein each frustoconical member has a distal end and an axial bore extending from the distal end into the housing; and a well comprising a wall, a base and a tapered cavity, wherein the wall extends from the second surface to a top edge, the tapered cavity is surrounded by the wall and extends from the top edge of the wall to the base and the base is located in the housing, wherein the well provides means for direct connection with an insert device without the use of an adapter.

2. The electrical connector according to claim 1, wherein the base of the well has an aperture that provides communication between the cavity and the axial bore of the first frustoconical member.

3. The electrical connector according to claim 1, wherein the well is adapted to receive a male interface of an insert device.

4. The electrical connector according to claim 3, wherein the insert device is a bushing insert or a feed-thru insert.

5. The electrical connector according to claim 2, wherein the well further comprises an electrical contact assembly that extends through the aperture in the base of the well.

6. The electrical connector according to claim 1, wherein the tapered cavity has a longitudinal axis that is aligned with the axial bore of the first frustoconical member.

7. The electrical connector according to claim 1, wherein the wall surrounding the cavity has an exterior surface and a pair of anchors extending therefrom for engaging a hold down bail.

8. The electrical connector according to claim 1, further comprising a lever arm attached to the perimetrical side wall of the housing, wherein the lever arm is adapted for connecting and disconnecting the connector.

9. The electrical connector according to claim 8, wherein the lever arm has a first end attached to the housing and a second end with an aperture for operation of the lever arm with a hotstick.

10. The electrical connector according to claim 1, wherein the second frustoconical member comprises an axial bore extending from the distal end into the housing.

11. The electrical connector according to claim 10, wherein the axial bore in the second frustoconical member is substantially parallel to the axial bore in the first frustoconical member.

12. An electrical connector for use in a power distribution system comprising:

a housing;

first and second frustoconical members extending downwardly from the housing, wherein each frustoconical member has a distal end and an axial bore; and a well integrally formed in a top surface of the housing, the well comprising a wall, a base, a tapered cavity and an electrical contact assembly, wherein the base of the well has an aperture that provides communication between the cavity and the axial bore of the first frustoconical member, wherein the electrical contact assembly extends through the aperture in the base of the well and wherein the well is adapted to directly receive a male interface of an insert device, thereby providing a connector having an overall reduced axial height.

13. The electrical connector according to claim 12, wherein the insert device is a bushing insert or a feed-thru insert.

14. The electrical connector according to claim 12, wherein the wall surrounds the tapered cavity and extends from the second surface to a top edge, the tapered cavity extends from the second surface into the housing and the base is located in the housing.

15. The electrical connector according to claim 14, wherein the wall surrounding the cavity has an exterior surface and a pair of anchors extending therefrom for engaging a hold down bail.

16. The electrical connector according to claim 12, further comprising a lever arm attached to the perimetrical side wall of the housing, wherein the lever arm is adapted for connecting and disconnecting the connector.

17. The electrical connector according to claim 16, wherein the lever arm has a first end attached to the housing and a second end with an aperture for operation of the lever arm with a hotstick.

* * * * *